US009077124B2

(12) United States Patent
Chen

(10) Patent No.: US 9,077,124 B2
(45) Date of Patent: Jul. 7, 2015

(54) CARD EDGE CABLE CONNECTOR ASSEMBLY

(71) Applicant: Bing Xu Precision Co., Ltd., New Taipei (TW)

(72) Inventor: Chih-jung Chen, New Taipei (TW)

(73) Assignee: Bing Xu Precision Co., Ltd., New Taipei (TW)

( * ) Notice: Subject to any disclaimer, the term of this patent is extended or adjusted under 35 U.S.C. 154(b) by 54 days.

(21) Appl. No.: 13/916,663

(22) Filed: Jun. 13, 2013

(65) Prior Publication Data

US 2013/0337694 A1 Dec. 19, 2013

(30) Foreign Application Priority Data

Jun. 15, 2012 (TW) ..... 101211543 U

(51) Int. Cl.
*H01R 12/72* (2011.01)
*H01R 13/66* (2006.01)

(52) U.S. Cl.
CPC ..... *H01R 12/721* (2013.01); *H01R 13/665* (2013.01)

(58) Field of Classification Search
CPC ..... H01R 13/6658; H01R 13/6594; H01R 24/60; H01R 9/03
USPC ..... 439/404, 630
See application file for complete search history.

(56) References Cited

U.S. PATENT DOCUMENTS

| | | | | |
|---|---|---|---|---|
| 4,850,899 | A * | 7/1989 | Maynard | 439/628 |
| 5,496,180 | A * | 3/1996 | Fabian et al. | 439/60 |
| 6,077,092 | A * | 6/2000 | Chiu et al. | 439/79 |
| 6,210,204 | B1 * | 4/2001 | Ko et al. | 439/404 |
| 6,890,210 | B2 * | 5/2005 | Lee | 439/404 |
| 2008/0227328 | A1 * | 9/2008 | Ju | 439/376 |
| 2008/0305651 | A1 | 12/2008 | Mostoller et al. | |
| 2010/0178809 | A1 * | 7/2010 | Tsai | 439/660 |
| 2012/0252256 | A1 * | 10/2012 | Zhu et al. | 439/357 |
| 2013/0005190 | A1 * | 1/2013 | Blanchfield et al. | 439/630 |

FOREIGN PATENT DOCUMENTS

CN 101682136 A 3/2010

* cited by examiner

*Primary Examiner* — Truc Nguyen

(57) ABSTRACT

A card edge connector assembly is disclosed. The card edge connector assembly includes an insulating housing, a first circuit board, a line transmission device, and a covering body. A plurality of first terminals and second terminals are inserted into the insulating housing. The first terminals and the second terminals are electrically connected to the line transmission device via the first circuit board. The first terminals are above the second terminals and mating portions of the first terminals and the second terminals stretch into a plug space of the insulating housing. In this way, the plug space can be used for the second circuit board to plug in such that the first terminals and the second terminals are electrically connected to the second circuit board.

8 Claims, 17 Drawing Sheets

CARD EDGE CABLE CONNECTOR ASSEMBLY

BACKGROUND OF THE INVENTION

1. Field of the Invention

The invention relates to a card edge cable connector assembly, and more particularly, to a card edge cable connector assembly electrically connected to a circuit board, comprising a cable and a plug space such that when the card edge portion of the circuit board is inserted into the plug space, the circuit board and the cable can be electrically connected to each other.

2. Description of the Prior Art

As disclosed in China Patent CN101682136, a card edge cable connector is a connector used for connecting a cable to a card edge interface. The card edge cable connector comprises a housing having a first surface and a second surface opposite to the first surface. The two surfaces separate the seam groove. The bifurcate contacting units are positioned inside the housing, where each contacting unit comprises naked a first bifurcate tooth portion, a second bifurcate tooth portion, a connecting board portion for connecting the first and the second bifurcate tooth portions, and a cable connecting portion for connecting the conductors of a cable.

However, in the aforementioned prior art, only the first bifurcate tooth portion is used as a contact for being connected to a printed circuit board (PCB). The second bifurcate tooth portion is merely used as a fixing end. Therefore, the current card edge cable connector only has a single row of contacts on the top of the connector. When more contacts are needed, the thickness of the PCB will be increased and the entire volume of the card edge connector will be increased. In addition, if the width of PCB is not increased, the both sides of the PCB should be able to be electrically connected and contacts should be positioned both on the top and the bottom of the card edge cable connector to form two rows of contacts. Therefore, the current card edge connector should be improved.

SUMMARY OF THE INVENTION

It is therefore one of the primary objectives of the claimed invention to provide a to a card edge cable connector comprising an insulating housing, a first circuit board, a line transmission device, and a covering body. A plurality of first terminals and second terminals are inserted into the insulating housing. The first terminals and the second terminals are electrically connected to the line transmission device via the first circuit board. The first terminals are above the second terminals and mating portions of the first terminals and the second terminals stretch into a plug space of the insulating housing. In this way, the plug space can be used for the second circuit board to plug in such that the first terminals and the second terminals are electrically connected to the second circuit board.

The first advantage of the present invention is to add a plurality of second terminals in addition to the first terminals. However, the contacts of the first terminals and the contacts of the second terminals are positioned as two rows, which are respectively on the top and the bottom. Therefore, the width of the insulating housing can be optimally small.

The second advantage of the present invention is that the first terminals and the second terminals can be electrically connected to a line transmission device via the first circuit board and the height of the first circuit board is less than or equal to the height of the insulating housing. Therefore, the height of the insulating housing can be optimally small.

The third advantage of the present invention is that the first side and the second side of the insulating housing have different thickness, and only the first side can be inserted into the groove of the second circuit board to achieve a fool-proof design.

The fourth advantage of the present invention is that when the card edge cable connector assembly or the second circuit board is shocked, the line transmission device can be used as a buffer. Furthermore, if the card edge cable connector assembly or the second circuit board is collided by an external force, the line transmission device can be used as a buffer to prevent the second circuit board from being damaged.

According to the present invention, a card edge cable connector assembly comprises: an insulating housing, comprising a plurality of first terminal holes, a plurality of second terminal holes, and a plurality of grooves; a first circuit board, comprising a plurality of first soldering portions, a plurality of second soldering portions, and a plurality of contacts; a plurality of first terminals, fastened in the grooves of the insulating housing, and ends of the first terminals are soldered together with the first soldering portions of the first circuit board; a plurality of second terminals, fastened in the grooves of the insulating housing, and ends of the second terminals are soldered together with the second soldering portions of the first circuit board; a line transmission device, comprising a plurality of conductors electrically connected to the contacts of the first circuit board; and a covering body, positioned in an end of the insulating housing and a front of the line transmission device in an over-molding way. The insulating housing further comprises a plug space. The first terminal holes are located on a top of the plug space. The second terminal holes are located on a bottom of the plug space. Mating portions of the first terminals stretch into the plug space via the first terminal holes, and mating portions of the second terminals stretch into the plug space via the second terminal holes.

In one aspect of the present invention, the first terminals are above the second terminals, and the mating portions of the first terminals and the mating portions of the second terminals are interlaced.

In another aspect of the present invention, the card edge cable connector assembly further comprises: a pulling band positioned on the insulating housing, wherein the insulating housing comprises a positioning block on a first side, and a pair of guiding blocks on a front end.

In another aspect of the present invention, the card edge cable connector assembly further comprises a second circuit board, comprising a card edge portion, comprising a plurality of contacts on a front and a back of the card edge portions. The card edge portion is capable of being plugged into the plug space of the insulating housing and the mating portions of the first terminals are capable of being electrically connected to the contacts on the front of the card edge portion. The mating portions of the second terminals are capable of being electrically connected to the contacts on the back of the card edge portion.

In another aspect of the present invention, a thickness of a first side of the insulating housing is less than a thickness of a second side of the insulating housing, and the first side of the insulating housing is capable of being plugged into a groove of the second circuit board.

In another aspect of the present invention, the second circuit board comprises a groove and a positioning portion. The insulating housing comprises a positioning block on a first side. The first side of the insulating housing is capable of being inserted into the groove of the second circuit board, and the positioning block is capable of being secured to the positioning portion of the second circuit board.

In another aspect of the present invention, the card edge cable connector assembly further comprises a third circuit board, comprising a flex flat cable connector. The line transmission device is capable of being inserted into the flex flat cable connector such that the third circuit board is electrically connected to the card edge cable connector assembly.

In another aspect of the present invention, the line transmission device is a flex flat cable, a flexible printed circuit board, or a wire cable.

According to the present invention, a card edge cable connector assembly comprises: an insulating housing, comprising a plurality of first terminal holes, a plurality of second terminal holes, and a plurality of grooves; a plurality of first terminals, fastened in the grooves of the insulating housing, and ends of the first terminals seal the grooves where the first terminals are fasted; a plurality of second terminals, fastened in the grooves of the insulating housing, and ends of the second terminals seal the grooves where the first terminals are fasted; a line transmission device, comprising a plurality of wire cables, wherein metal wires of the wire cables are electrically connected to the ends of the first terminals and the ends of the second terminals; a covering body, positioned in an end of the insulating housing and a front of the line transmission device in an over-molding way. The insulating housing further comprises a plug space. The first terminal holes are located on a top of the plug space. The second terminal holes are located on a bottom of the plug space. Mating portions of the first terminals stretch into the plug space via the first terminal holes, mating portions of the second terminals stretch into the plug space via the second terminal holes, and the mating portions of the first terminals and the mating portions of the second terminals are interlaced.

In one aspect of the present invention, the card edge cable connector assembly further comprises: a pulling band positioned on the insulating housing. The insulating housing comprises a positioning block on a first side, and a pair of guiding blocks on a front end.

In another aspect of the present invention, a thickness of a first side of the insulating housing is less than a thickness of a second side of the insulating housing.

According to the present invention, a card edge cable connector assembly comprises: an insulating housing, comprising a plurality of first terminal holes, a plurality of second terminal holes, and a plurality of grooves; a plurality of first terminals, fastened in the grooves of the insulating housing, and ends of the first terminals seal the grooves where the first terminals are fasted; a plurality of second terminals, fastened in the grooves of the insulating housing, and ends of the second terminals seal the grooves where the first terminals are fasted; a line transmission device, comprising a plurality of wire cables, wherein metal wires of the wire cables are electrically connected to the ends of the first terminals and the ends of the second terminals; and a cover, secured to an end of the insulating housing. The insulating housing further comprises a plug space. The first terminal holes are located on a top of the plug space. The second terminal holes are located on a bottom of the plug space. Mating portions of the first terminals stretch into the plug space via the first terminal holes, mating portions of the second terminals stretch into the plug space via the second terminal holes, and the mating portions of the first terminals and the mating portions of the second terminals are interlaced.

In one aspect of the present invention, a front of the line transmission device has a bending angle, and glue is spread from the ends of the first terminals and the ends of the second terminals to the front of the transmission device.

In another aspect of the present invention, the cover comprises a pair of piercers for securing a pair of roots of the end of the insulating housing, and a notch, wherein the line transmission device stretches outside via the notch.

In another aspect of the present invention, the cover comprises a rectangular frame and a pair of piercers. The line transmission device stretches outside via the rectangular frame, and the cover utilizes the piercers to secure a pair of roots of the end of the insulating housing.

In another aspect of the present invention, the card edge cable connector assembly further comprises a pulling band positioned on the insulating housing or the cover.

In another aspect of the present invention, the insulating housing comprises a positioning block on a first side, and a pair of guiding blocks on a front end.

In another aspect of the present invention, a thickness of a first side of the insulating housing is less than a thickness of a second side of the insulating housing.

These and other objectives of the claimed invention will no doubt become obvious to those of ordinary skill in the art after reading the following detailed description of the preferred embodiment that is illustrated in the various figures and drawings.

DETAILED DESCRIPTION OF THE PREFERRED EMBODIMENT

Figure 1:
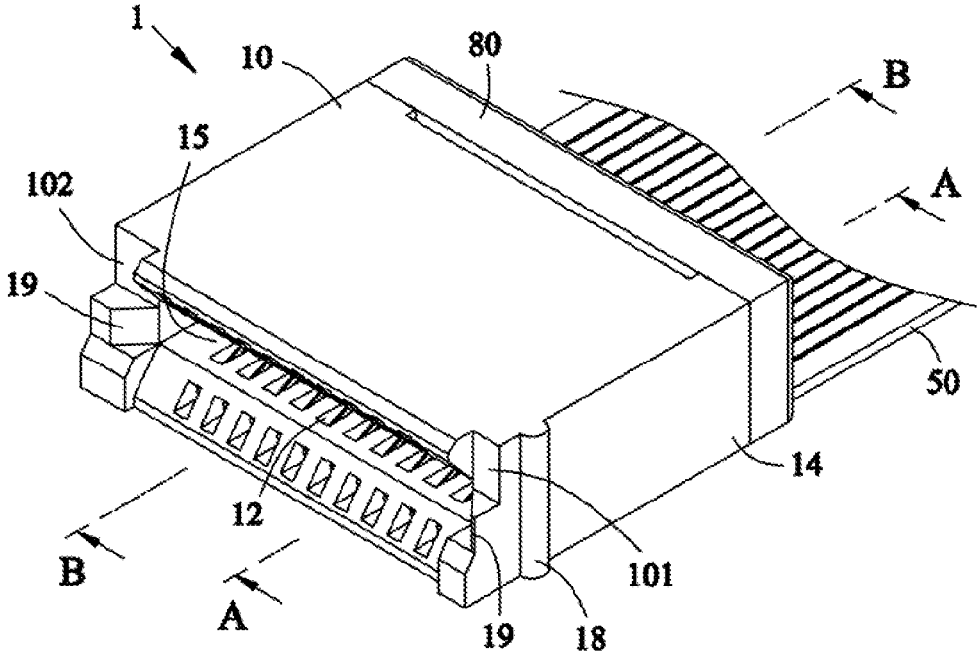
FIG. 1 is a diagram showing a card edge connector assembly according to a preferred embodiment of the present invention.
Figure 2:
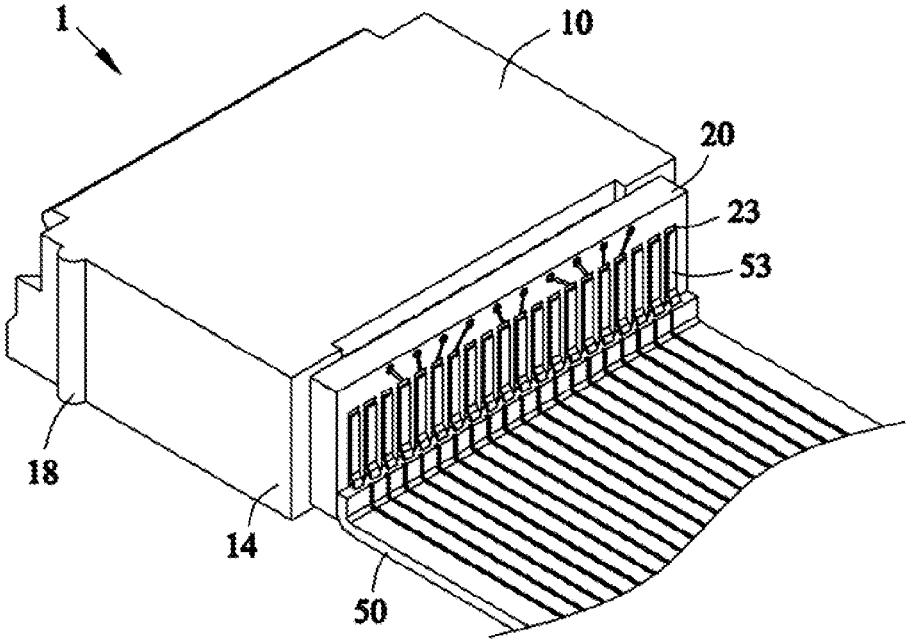
FIG. 2 is a diagram showing a card edge connector assembly without the covering body according to a preferred embodiment of the present invention.
Figure 3:
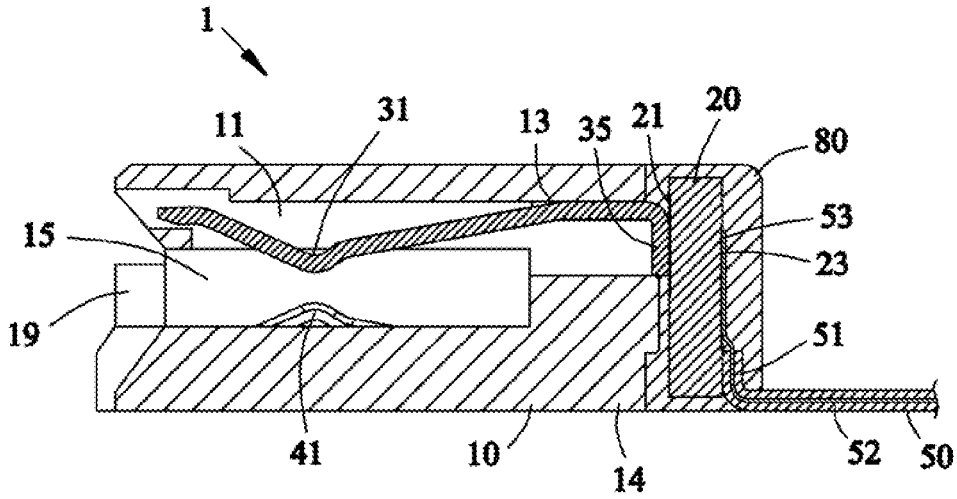
FIG. 3 is a cross-section view of A-A line in FIG. 1.
Figure 4:
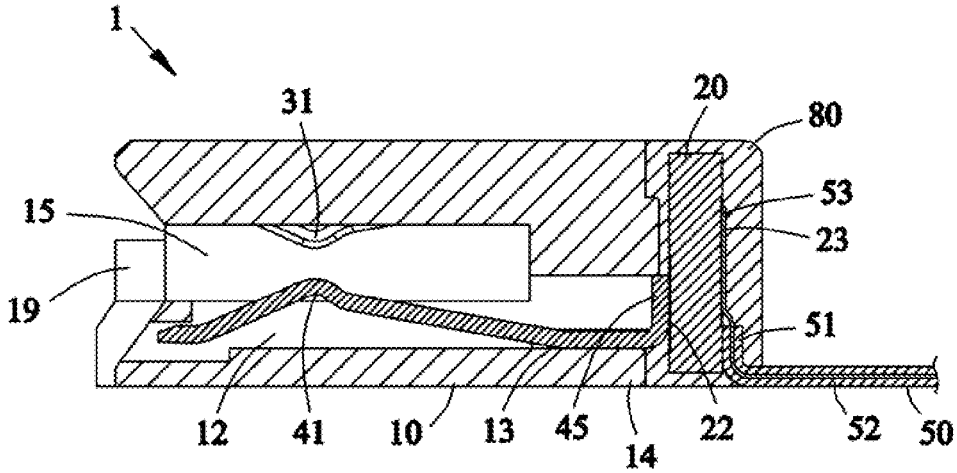
FIG. 4 is a cross-section view of B-B line in FIG. 1.
Figure 5:
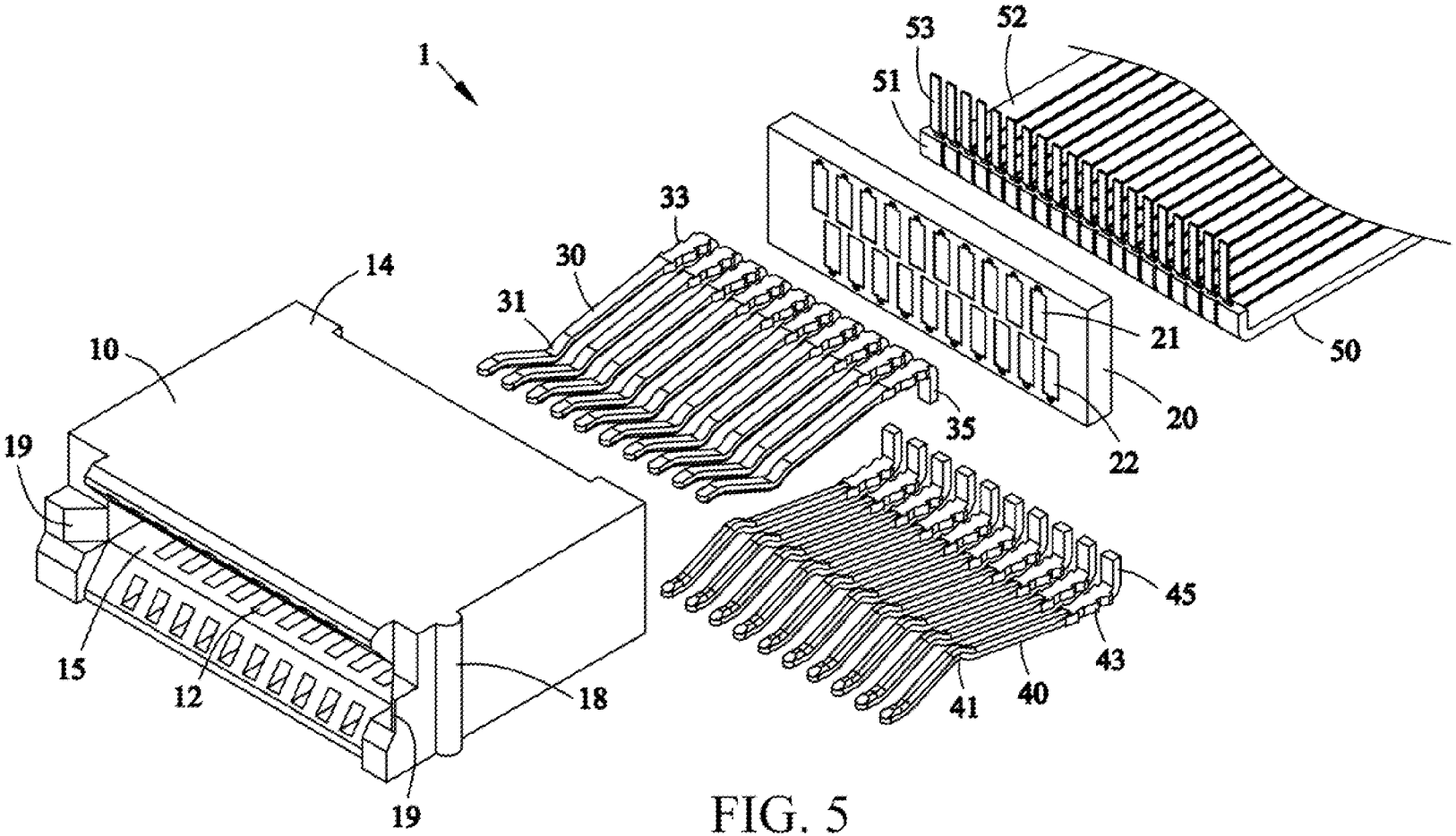
FIG. 5 is an explosion diagram (1) showing a card edge connector assembly according to a preferred embodiment of the present invention.
Figure 6:
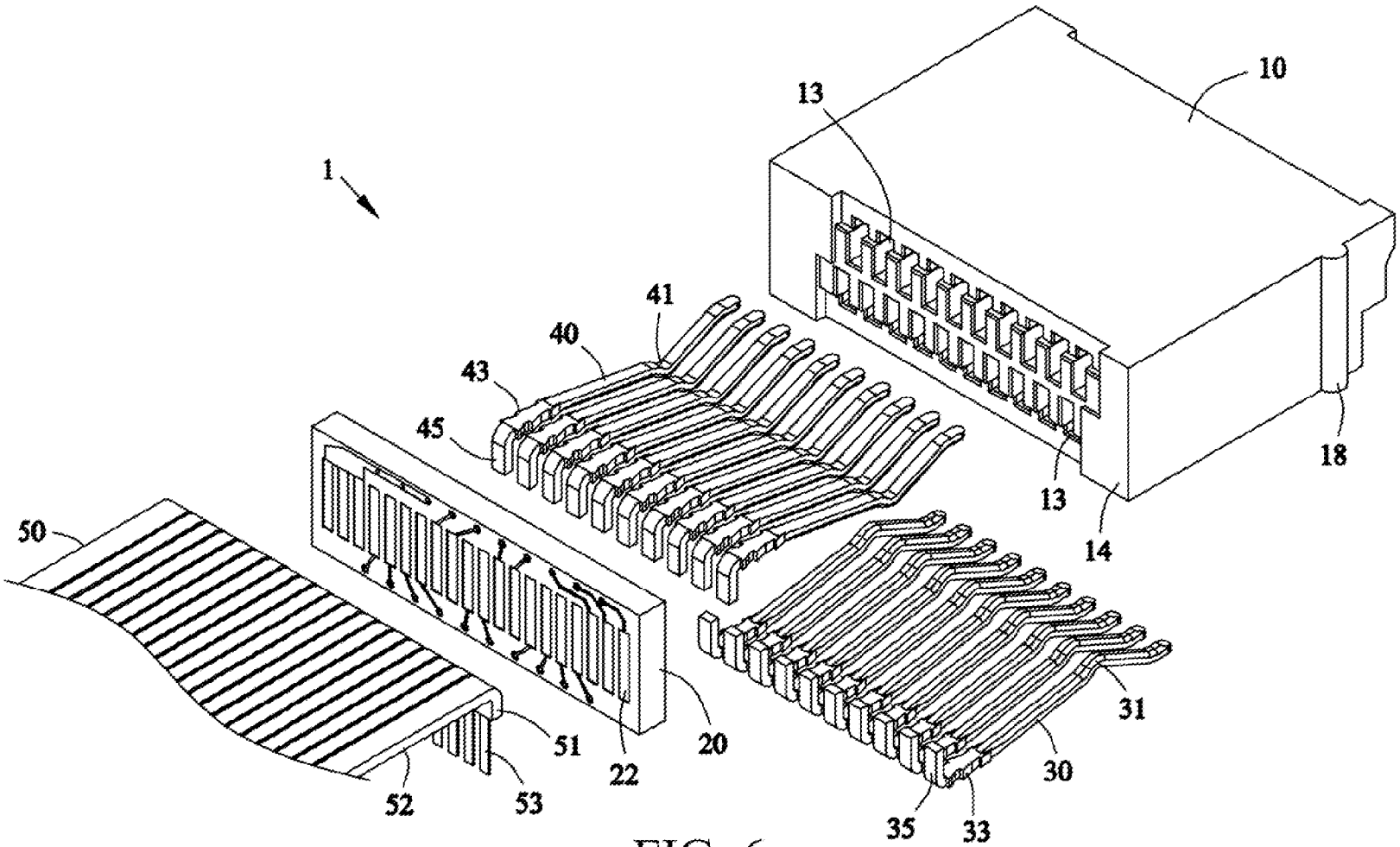
FIG. 6 is an explosion diagram (2) showing a card edge connector assembly according to a preferred embodiment of the present invention.
Figure 7:
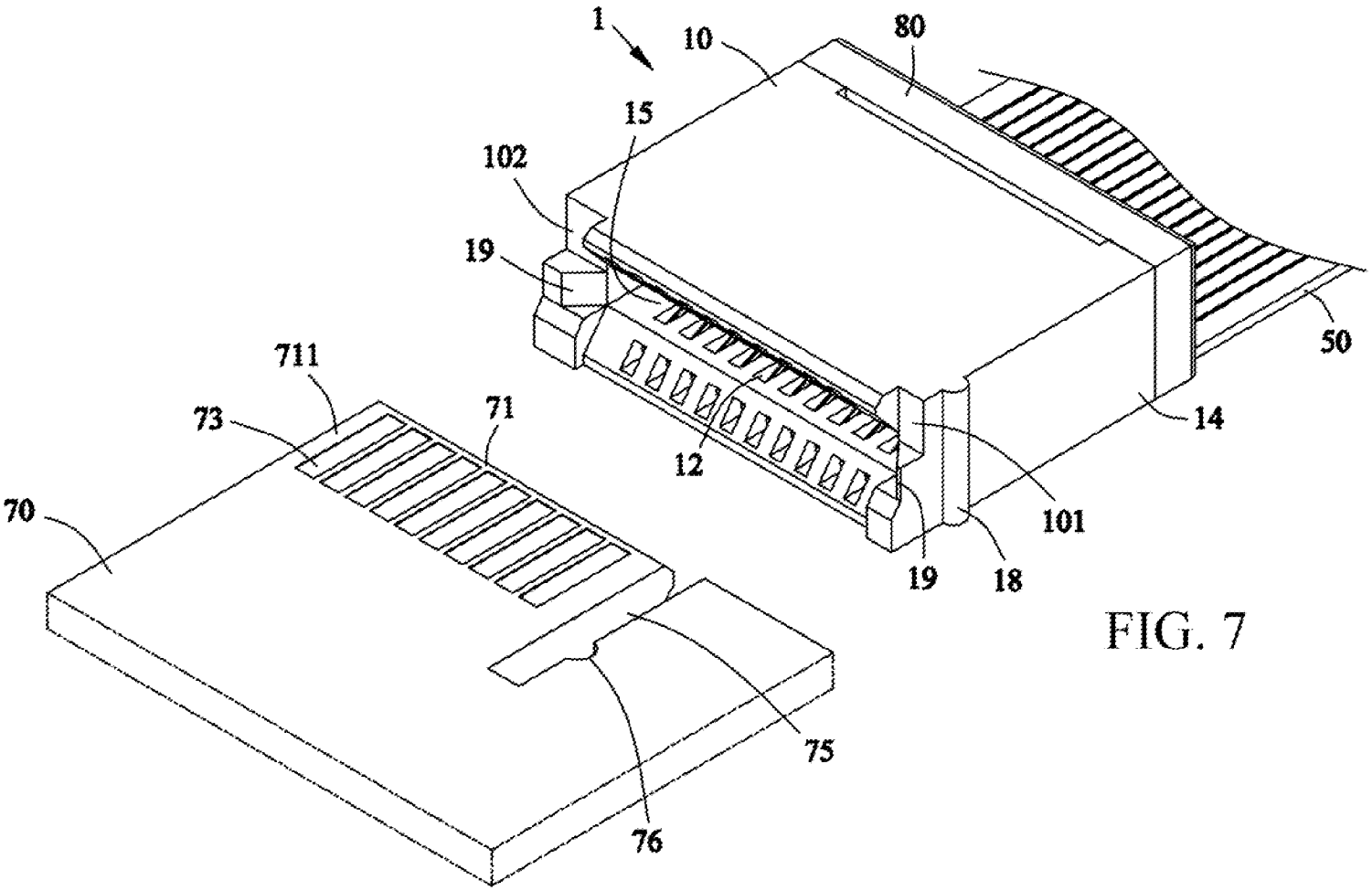
FIG. 7 is an explosion diagram (1) showing a card edge connector assembly according to a second embodiment of the present invention.
Figure 8:
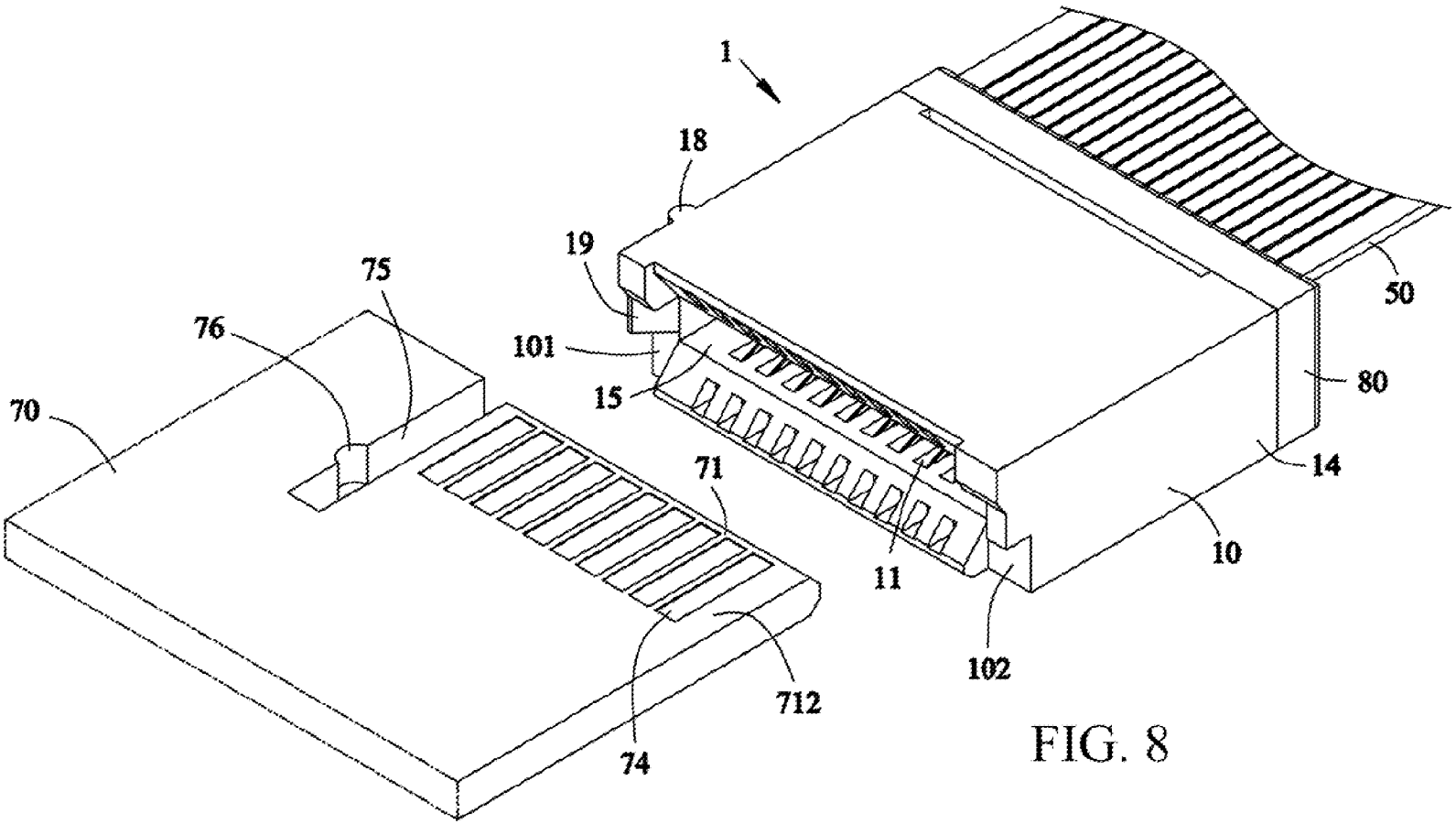
FIG. 8 is an explosion diagram (2) showing a card edge connector assembly according to a second embodiment of the present invention.

Please refer to FIG. 1-FIG. 6. In a preferred embodiment, the card edge cable connector 1 comprises an insulating housing 10, a first circuit board 20, a plurality of first terminals 30, a plurality of second terminals 40, a line transmission device 50, and a covering body 80. The insulating housing 10 comprises a plurality of first terminal holes 11, a plurality of second terminals holes 12, and a plurality of grooves 13. The first circuit board 20 comprises a plurality of first soldering portions 21, a plurality of second soldering portions 22, and a plurality of contacts 23. The first terminals 30 are fastened together with the grooves 13 of the insulating housing 10 (ex: the pierces 33 are fastened with the grooves 13). The ends 35 of the first terminals 30 are soldered to the first soldering portions 21 of the first circuit board 20. The second terminals 40 are fastened together with the grooves 13 of the insulating housing 10 (ex: the pierces 43 are fastened with the grooves 13). The ends 45 of the second terminals 40 are soldered to the second soldering portions 22 of the first circuit board 20. The line transmission device 50 can be a flex flat cable or flexible printed circuit board having an insulating layer 52. The insulating layer 52 covers a plurality of conductors 53. The conductors 53 are electrically connected to the contacts 23 of the first circuit board 20. The covering body 80 is positioned on the end 14 of the insulating housing 10 and the front 51 of the line transmission device 50 in an over-molding way. The insulating housing 10 comprises a plug space 15. The first terminal holes 11 are on the top of the plug space 15, and the second terminal holes 12 are on the bottom of the plug space 15. The mating portions 31 of the first terminals 30 stretch into the plug space 15 via the first terminal holes 11, and mating portions 41 of the second terminals 40 stretch into the plug space 15 via the second terminal holes 12. Please note, although the present invention add the second terminals 40 in addition to the first terminals 30, the mating portions 31 and the mating portions 41 are arranged in two rows. Therefore, the width of the insulating housing 10 can be optimally small. Furthermore, the first terminals 30 and the second terminals 40 are electrically connected to the line transmission device 50 via the first circuit board 20 and the height of the first circuit board 20 is less than or equal to the height of the insulating housing 10. Therefore, the height of the insulating housing 10 can be optimally small.

The arrangement of the first terminals 30 and the second terminals 40 is illustrated as follows: the first terminals 30 and the second terminals 40 can be inserted into the end 14 of the insulating housing 10 and fastened into the insulating housing 10. The first terminals 30 are above the second terminals 40 and the mating portions 31 of the first terminals 30 and the mating portions 41 of the second terminals 40 are interlaced as shown in FIG. 1-FIG. 4.

Please refer to FIG. 7-FIG. 12. The card edge cable connector assembly 1 further comprises a second circuit board 70 (ex: the circuit board of a hard disk, an optical disk drive, or any other electronic device). The first side 101 of the insulating housing 10 further comprises a positioning block 18, and the front of the insulating housing 10 further comprises a pair of guiding blocks 19. The second circuit board 70 comprises a card edge portion 71. A plurality of contacts 73 and 74 are positioned on the front 711 and back 712 of the card edge portion 71. The card edge portion 71 can be guided by the guiding blocks 19 to be plugged into the plug space 15 of the insulating housing 10. When the card edge portion 71 is in the plug space 15, the mating portions 31 of the first terminals 30 can be electrically connected to the contacts 73 of the front 711 of the card edge portion 71 and the mating portions 41 of the second terminals 40 can be electrically connected to the contacts 74 of the back 712 of the card edge portion 71. When the card edge cable connector assembly 1 or the second circuit board 70 is shocked, the line transmission device 50 can be utilized as a buffer. In addition, when the card edge cable connector assembly 1 or the second circuit board 70 is collided by an external force, the line transmission device 50 can be utilized as a buffer to prevent the second circuit board 70 from being damaged.

The positioning mechanism of the insulating housing 10 and the second circuit board 70 is illustrated as follows: the second circuit board 70 further comprises a groove 75 and a positioning portion 76. The first side 101 of the insulating housing 10 can be inserted into the groove 75 of the second circuit board 70 and the positioning block 18 of the insulating housing 10 can be secured to the positioning portion 76 of the second circuit board 70. In this way, the positioning of the insulating housing 10 and the second circuit board 70 is achieved as shown in FIG. 7-FIG. 10.

Figure 9:
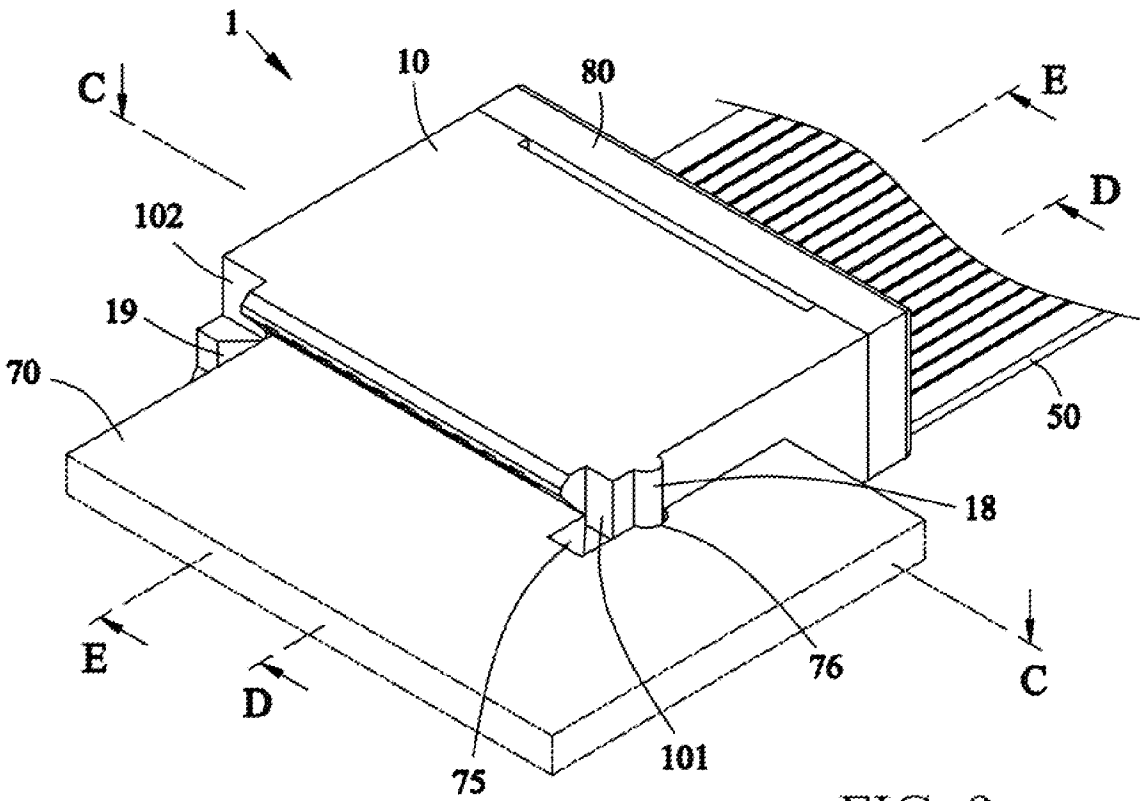
FIG. 9 is a diagram showing a card edge connector assembly according to a second embodiment of the present invention.
Figure 10:
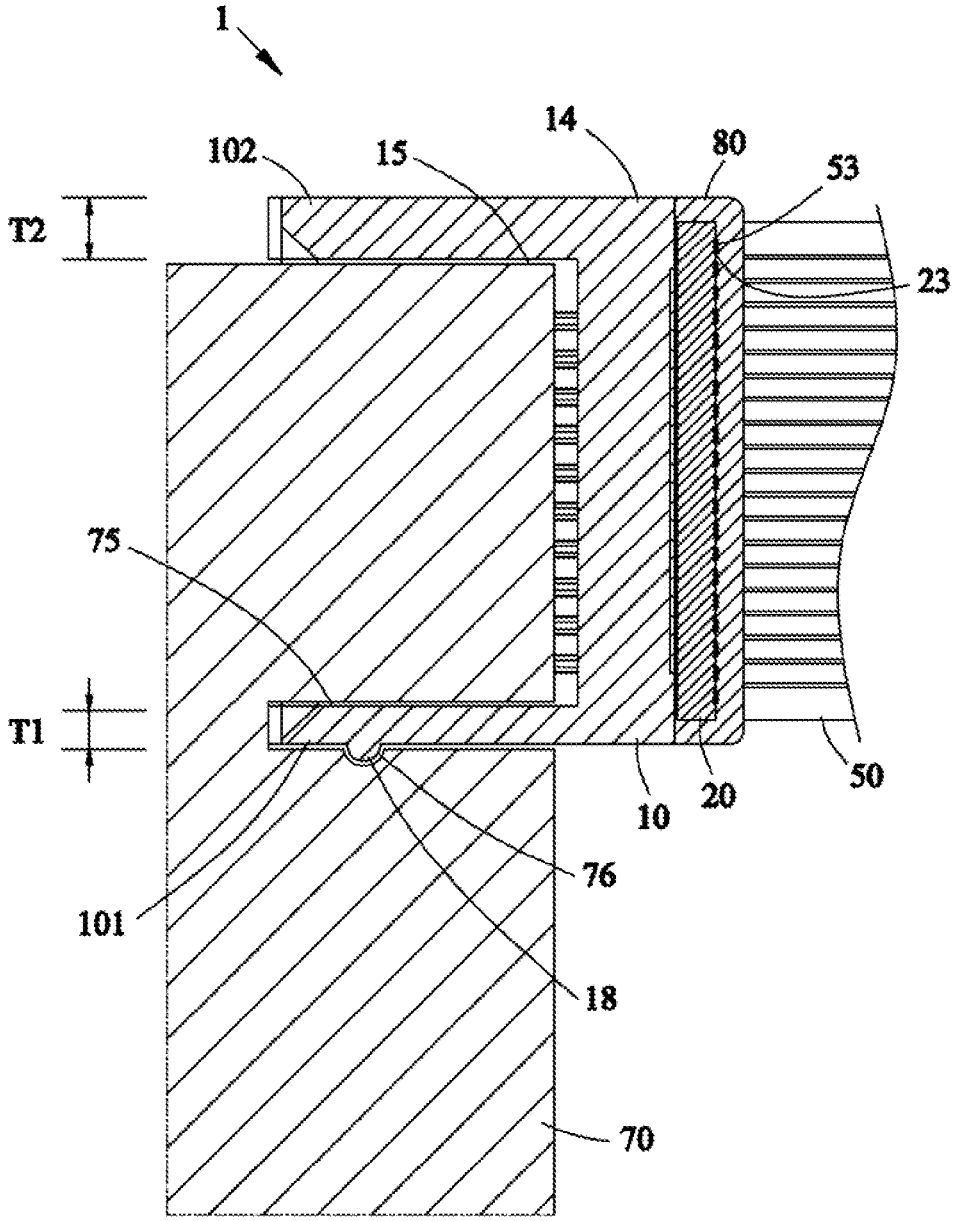
FIG. 10 is a cross-section view of C-C line in FIG. 9.
Figure 11:
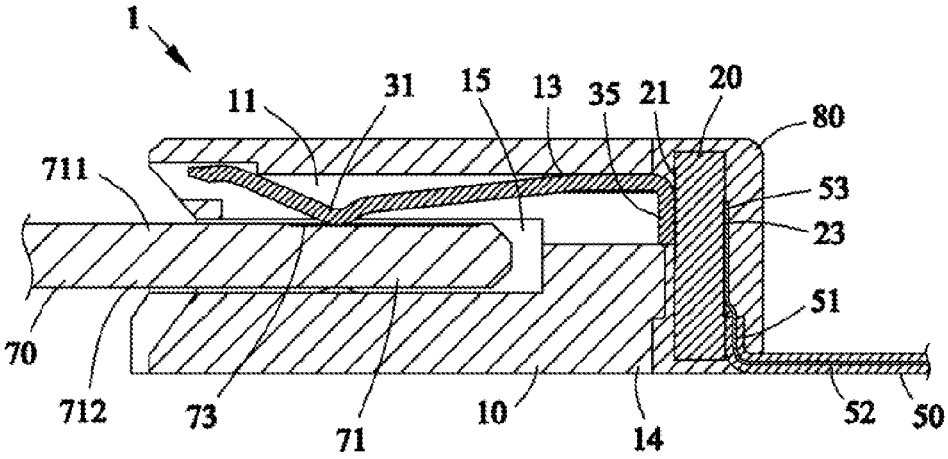
FIG. 11 is a cross-section view of D-D line in FIG. 9.
Figure 12:
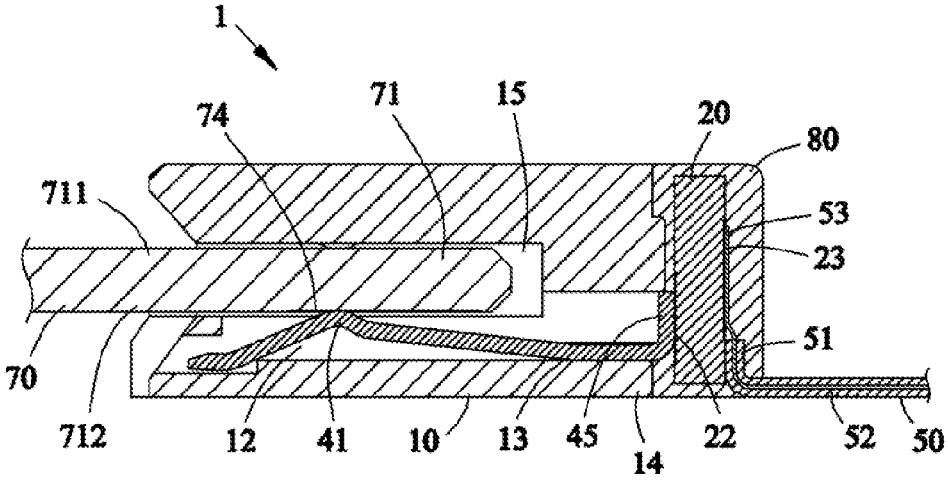
FIG. 12 is a cross-section view of E-E line in FIG. 9.

The fool-proof mechanism of the insulating housing 10 and the second circuit board 70 is illustrated as follows: the first side 101 and the second side 102 of the insulating housing 10 have different thicknesses. The thickness T1 of the first side 101 corresponds to the groove 75 of the second circuit board 70, but the thickness T2 of the second side 102 does not correspond to the groove 75 of the second circuit board 70. Therefore, only the first side 101 can be inserted into the groove 75 of the second circuit board. In this way, the fool-proof mechanism is achieved as shown in FIG. 9-FIG. 10.

Figure 13:
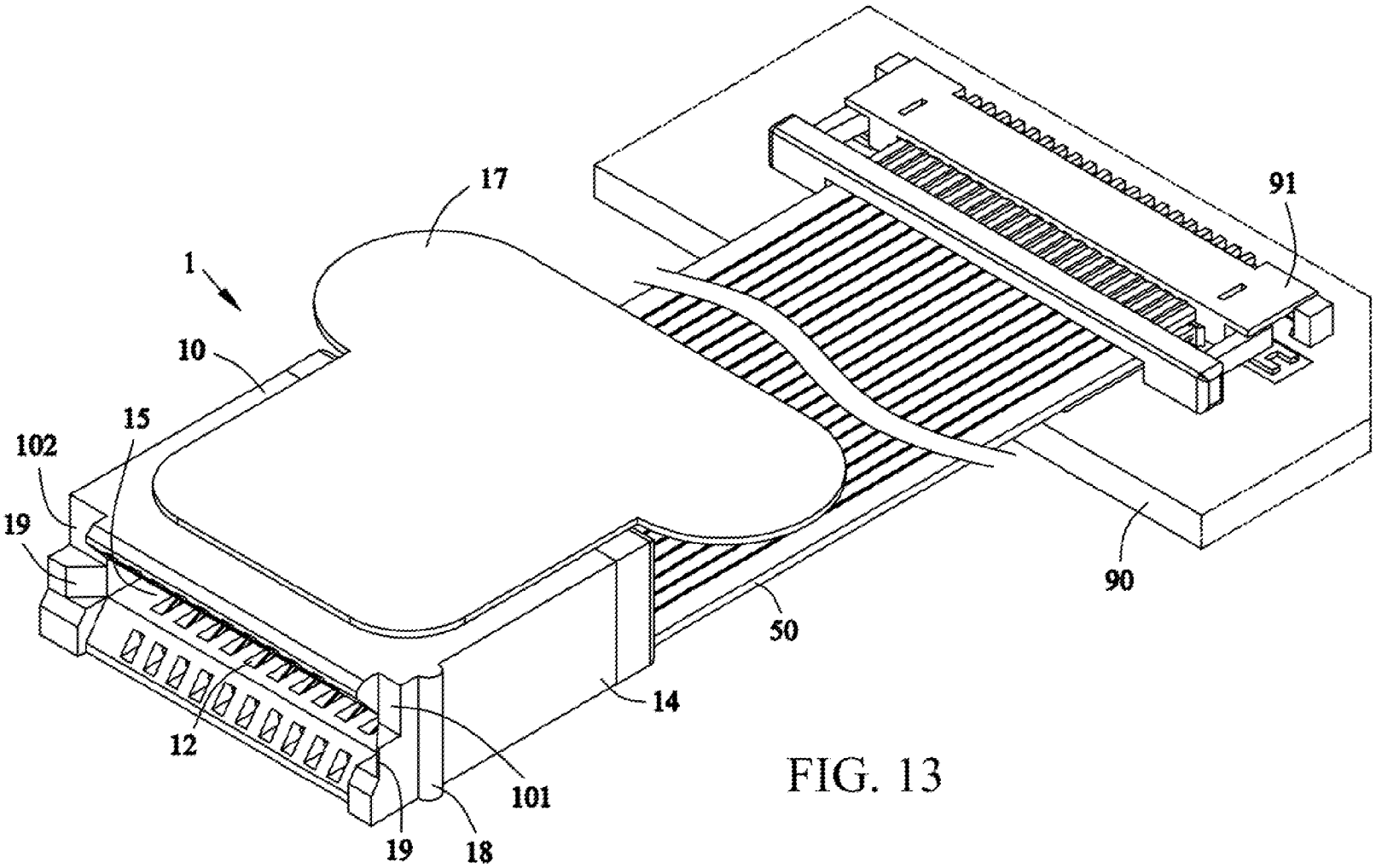
FIG. 13 is a diagram showing a card edge connector assembly according to a third embodiment of the present invention.
Figure 14:
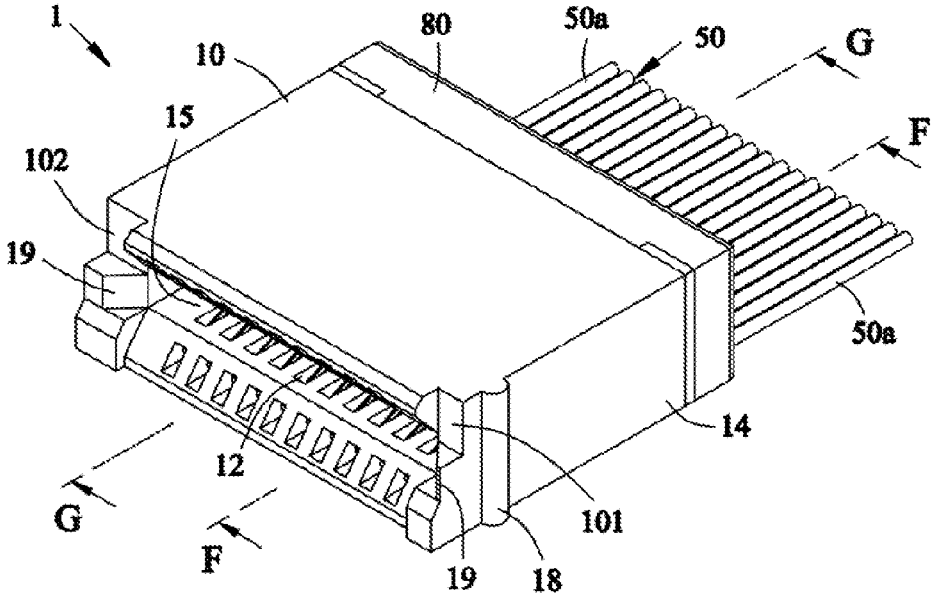
FIG. 14 is a diagram (1) showing a card edge connector assembly according to a fourth embodiment of the present invention.
Figure 15:
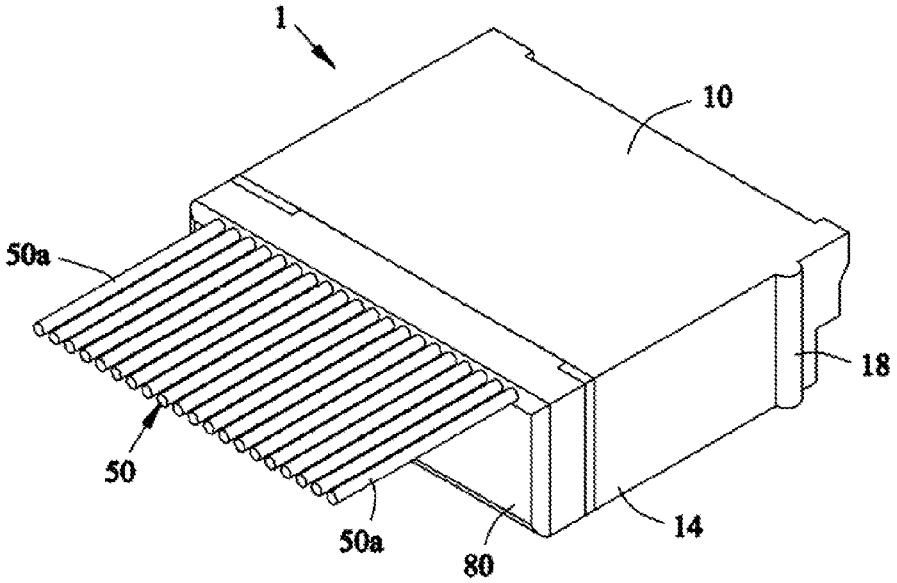
FIG. 15 is a diagram (2) showing a card edge connector assembly according to a fourth embodiment of the present invention.
Figure 16:
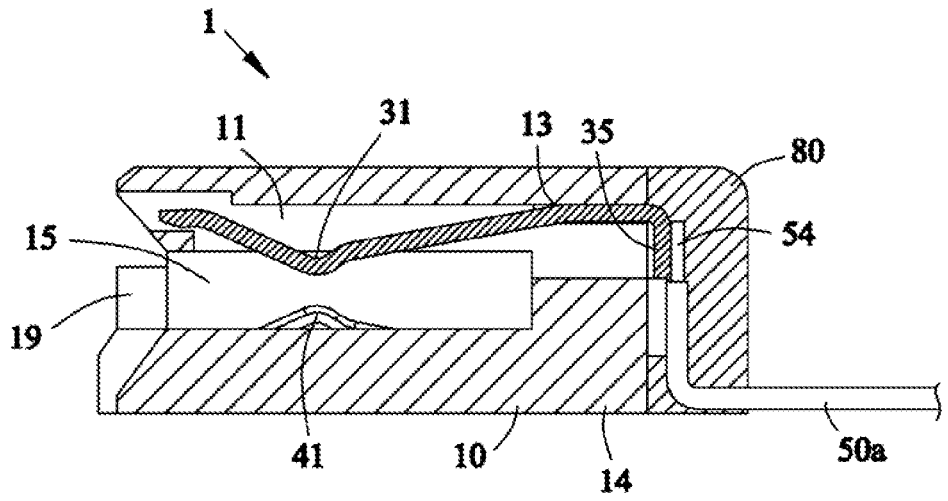
FIG. 16 is a cross-section view of F-F line in FIG. 14.
Figure 17:
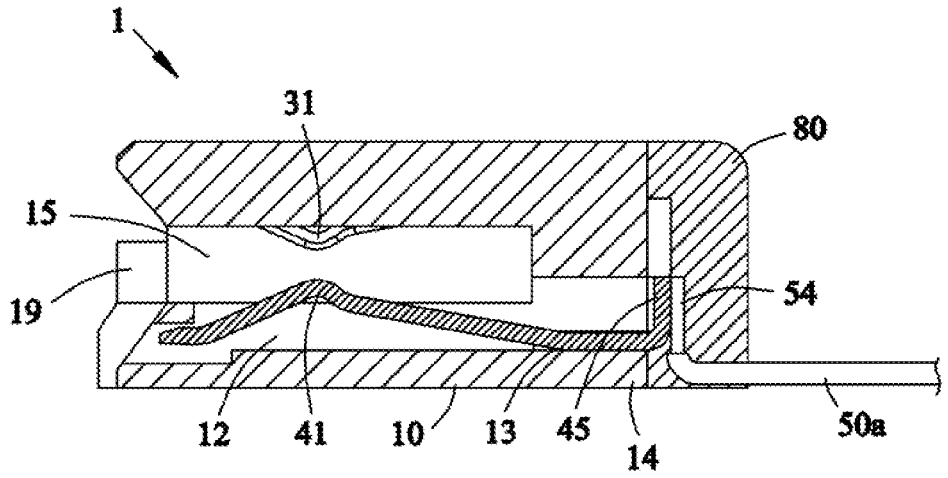
FIG. 17 is a cross-section view of G-G line in FIG. 14.
Figure 18:
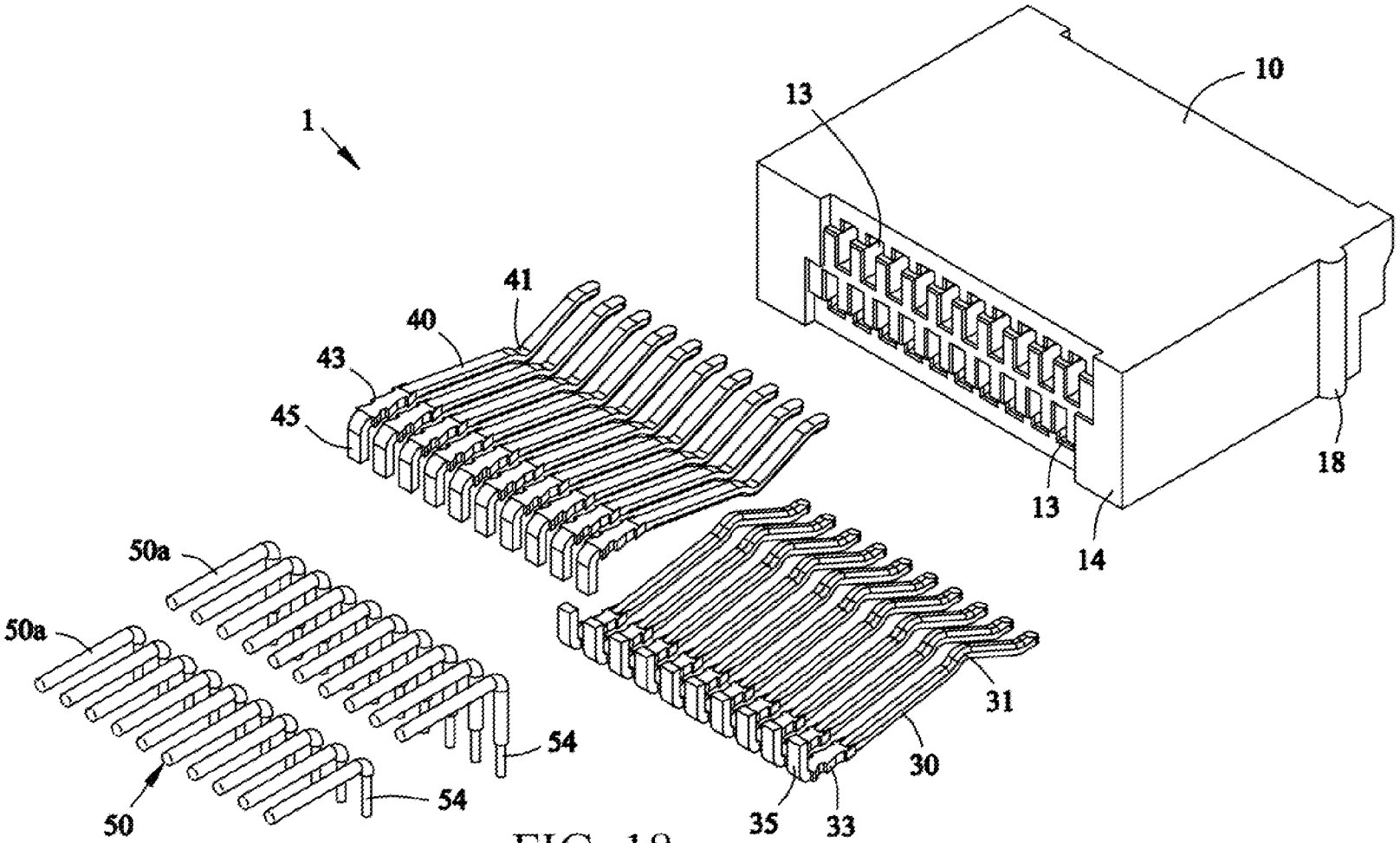
FIG. 18 is an explosion diagram showing a card edge connector assembly according to a fourth embodiment of the present invention.

Please refer to FIG. 13. The card edge cable connector assembly 1 further comprises a pulling band 17 and a third circuit board 90. The pulling band 17 can be secured on the insulating housing 10. The third circuit board 90 comprises a flex flat cable connector or a flexible printed circuit board connector 91. The line transmission device 50 can be inserted into the flex flat cable connector or the flexible printed circuit board connector 91 such that the card edge cable connector assembly 1 is electrically connected to the third circuit board 90.

Please refer to FIG. 14-FIG. 18. In a fourth embodiment, the card edge cable connector 1 comprises an insulating housing 10, a plurality of first terminals 30, a plurality of second terminals 40, a line transmission device 50, and a covering body 80. The insulating housing 10 comprises a plurality of first terminal holes 11, a plurality of second terminals holes 12, and a plurality of grooves 13. The first terminals 30 are fastened together with the grooves 13 of the insulating housing 10 (ex: the pierces 33 are fastened with the grooves 13). The ends 35 of the first terminals 30 seal the grooves 13 where the first terminals 30 are fastened. The second terminals 40 are fastened together with the grooves 13 of the insulating housing 10 (ex: the pierces 43 are fastened with the grooves 13). The ends 45 of the second terminals 40 seal the grooves 13 where the second terminals 40 are fastened. The line transmission device 50 comprises a plurality of wire cables 50*a*. Each wire cable comprises a metal wire 54. The wire cables 54 are electrically connected to the ends 35 of the first terminals 30 and the ends 45 of the second terminals 40. The covering body 80 is positioned on the end 14 of the insulating housing 10 and the front 51 of the line transmission device 50 in an over-molding way. The insulating housing 10 comprises a plug space 15. The first terminal holes 11 are on the top of the plug space 15, and the second terminal holes 12 are on the bottom of the plug space 15. The mating portions 31 of the first terminals 30 stretch into the plug space 15 via the first terminal holes 11, and mating portions 41 of the second terminals 40 stretch into the plug space 15 via the second terminal holes 12. Because the ends 35 of the first terminals 30 and the ends 45 of the second terminals 40 seal the grooves 13 where the first terminals 30 and second terminals 40 are fastened, when the covering body 80 is formed in the over-molding way, it can prevent from over-flowing the covering body 80 to the first terminals holes 11 and the second terminal holes 12. Please note, although the present invention add the second terminals 40 in addition to the first terminals 30, the mating portions 31 and the mating portions 41 are arranged in two rows. Therefore, the width of the insulating housing 10 can be optimally small. Furthermore, the first terminals 30 and the second terminals 40 are electrically connected to the line transmission device 50 via the first circuit board 20 and the height of the first circuit board 20 is less than or equal to the height of the insulating housing 10. Therefore, the height of the insulating housing 10 can be optimally small.

Figure 19:
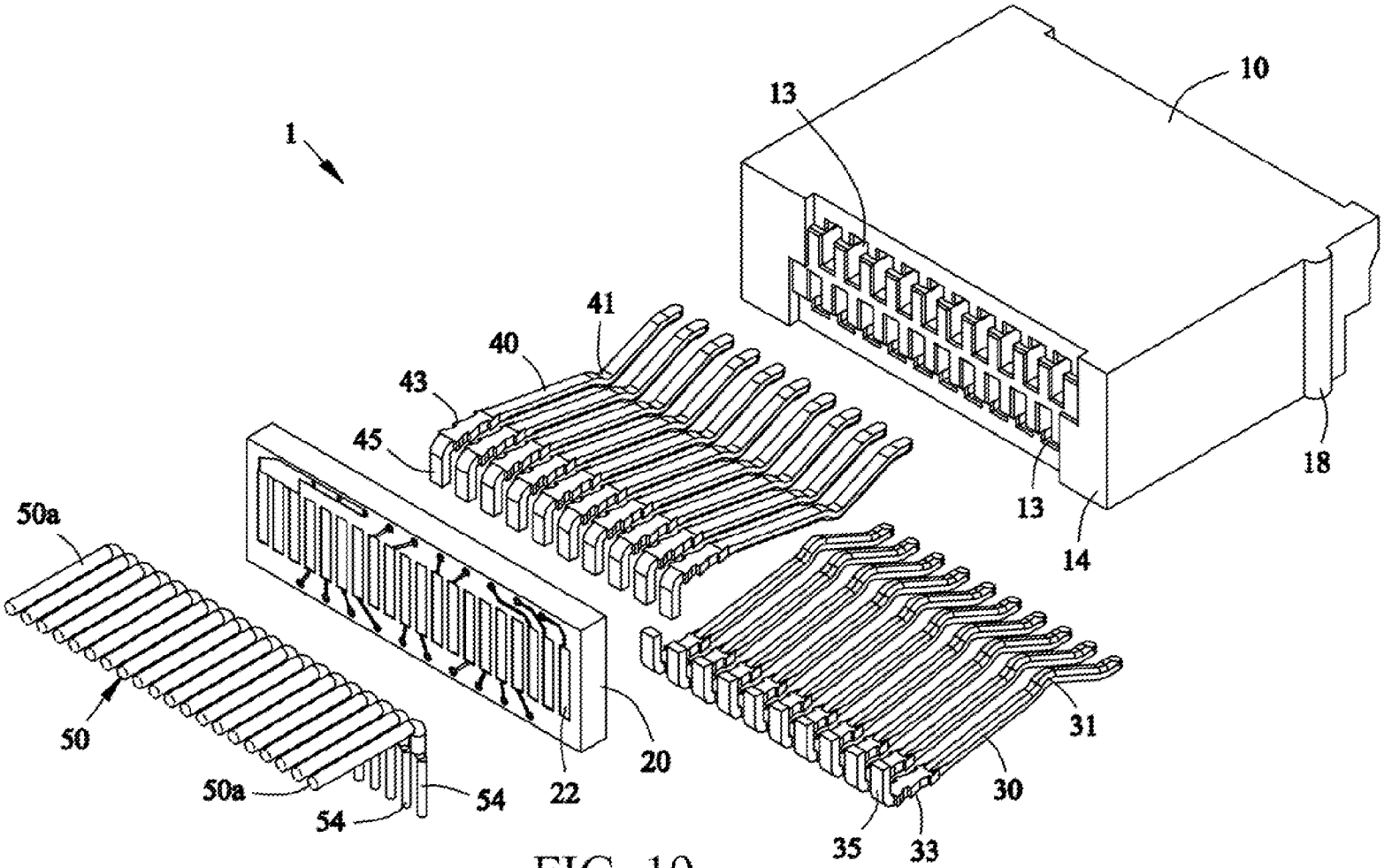
FIG. 19 is an explosion diagram showing a card edge connector assembly according to a fifth embodiment of the present invention.

Please refer to FIG. 19. The card edge cable connector assembly 1 in the fifth embodiment is mostly the same as the preferred embodiment, and the difference between them is: in the fourth embodiment, the line transmission device 50 comprises a plurality of wire cables 50*a* and each wire cable 50*a* comprises a metal wire 54. The metal wires 54 of the wire cables 50*a* are electrically connected to the contacts 23 of the first circuit board. This also obeys the spirit of the present invention.

Figure 20:
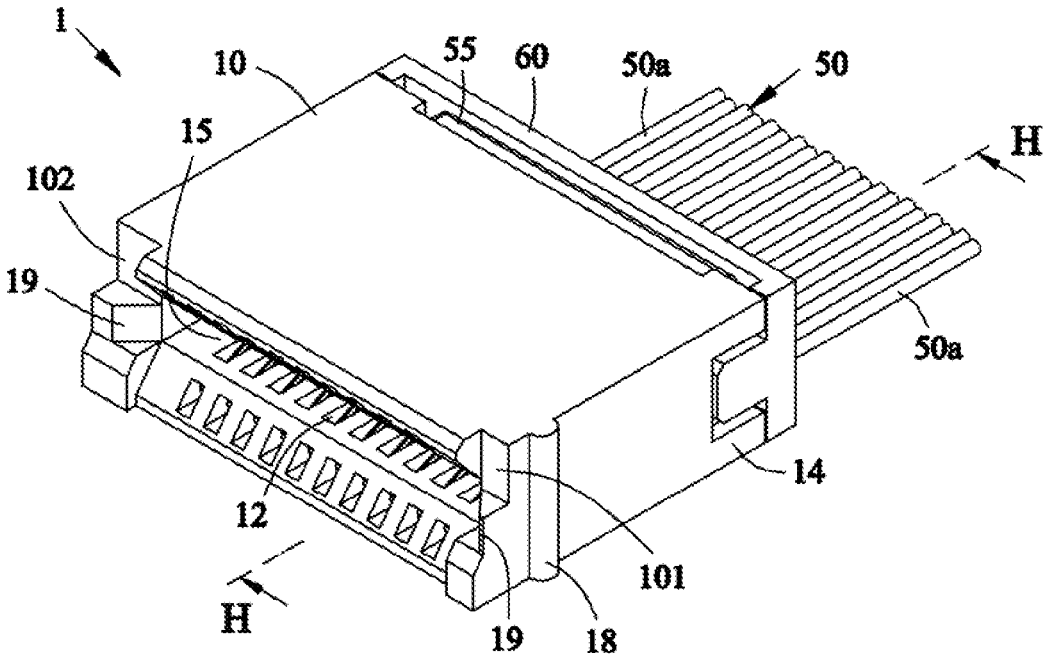
FIG. 20 is a diagram showing a card edge connector assembly according to a sixth embodiment of the present invention.
Figure 21:
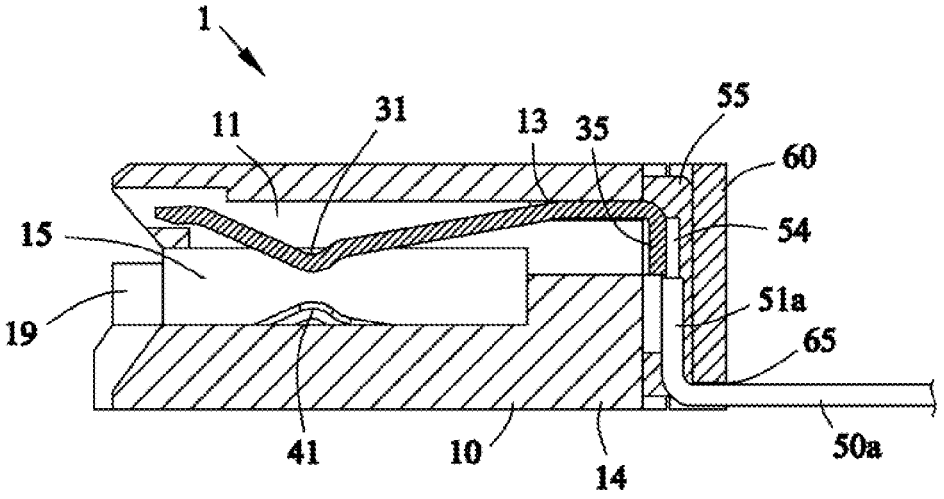
FIG. 21 is a cross-section view of H-H line in FIG. 20.
Figure 22:
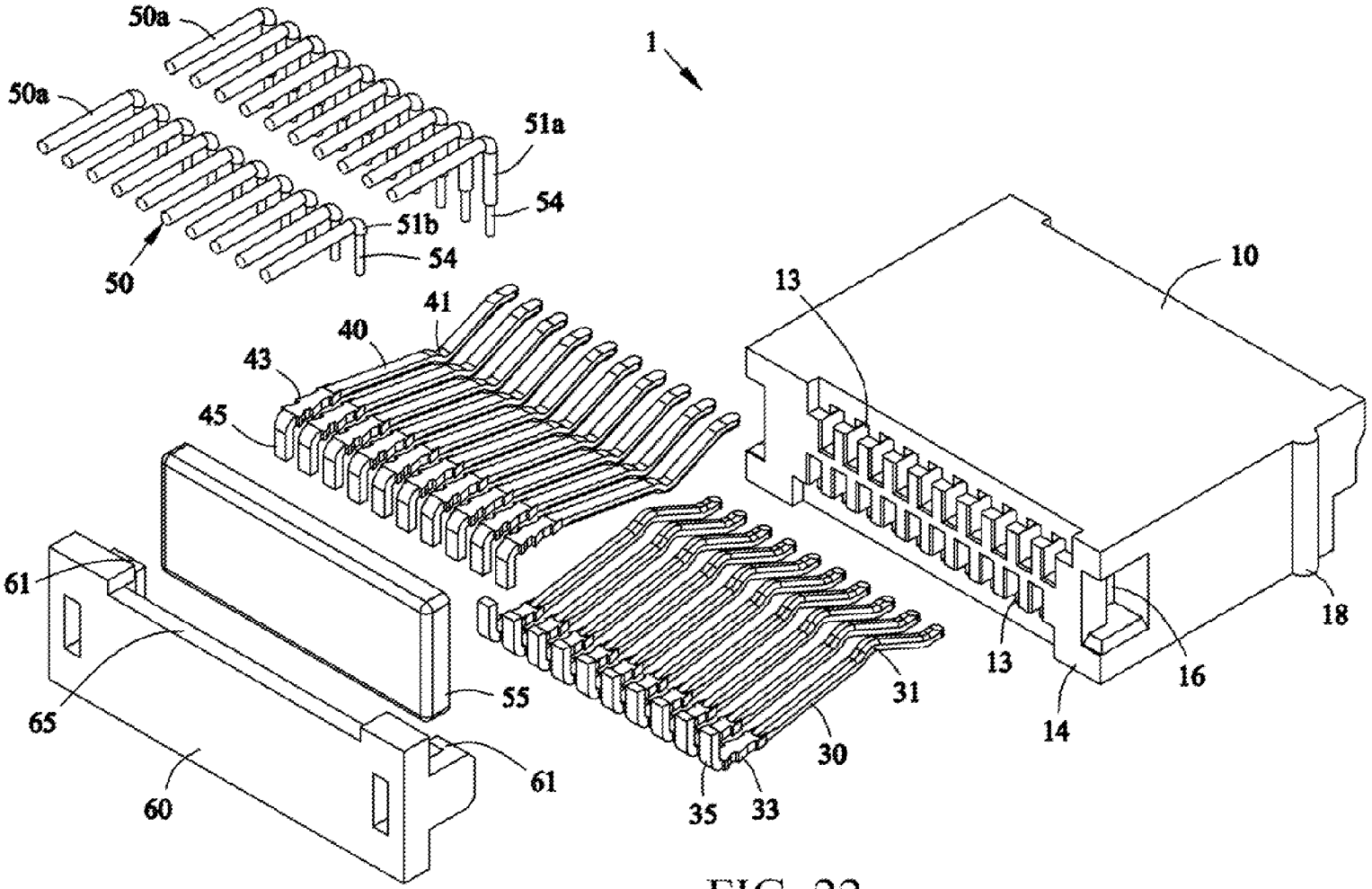
FIG. 22 is a partial explosion diagram showing a card edge connector assembly according to a sixth embodiment of the present invention.

Please refer to FIG. 20-FIG. 22. The card edge cable connector assembly 1 in the sixth embodiment is mostly the same as the fourth embodiment, and the difference between them is: in the sixth embodiment, the covering body is replaced by a cover 60. The cover 60 is secured to the end 14 of the insulating housing 10. Glue 55 is spread on the ends 35 of the first terminals 30, the ends 45 of the second terminals 40, and the fronts 51*a* and 51*b* of the line transmission device 50. The fronts 51*a* and 51*b* of the line transmission device 50 have a bending angle. The cover 60 utilizes a pair of pierces 61 to secure a pair of positioning portions 16 of the insulating housing 10. The cover 60 comprises a notch 65. The line transmission device 50 can stretch outside via the notch 65 of the cover 60. This also obeys the spirit of the present invention.

Figure 23:
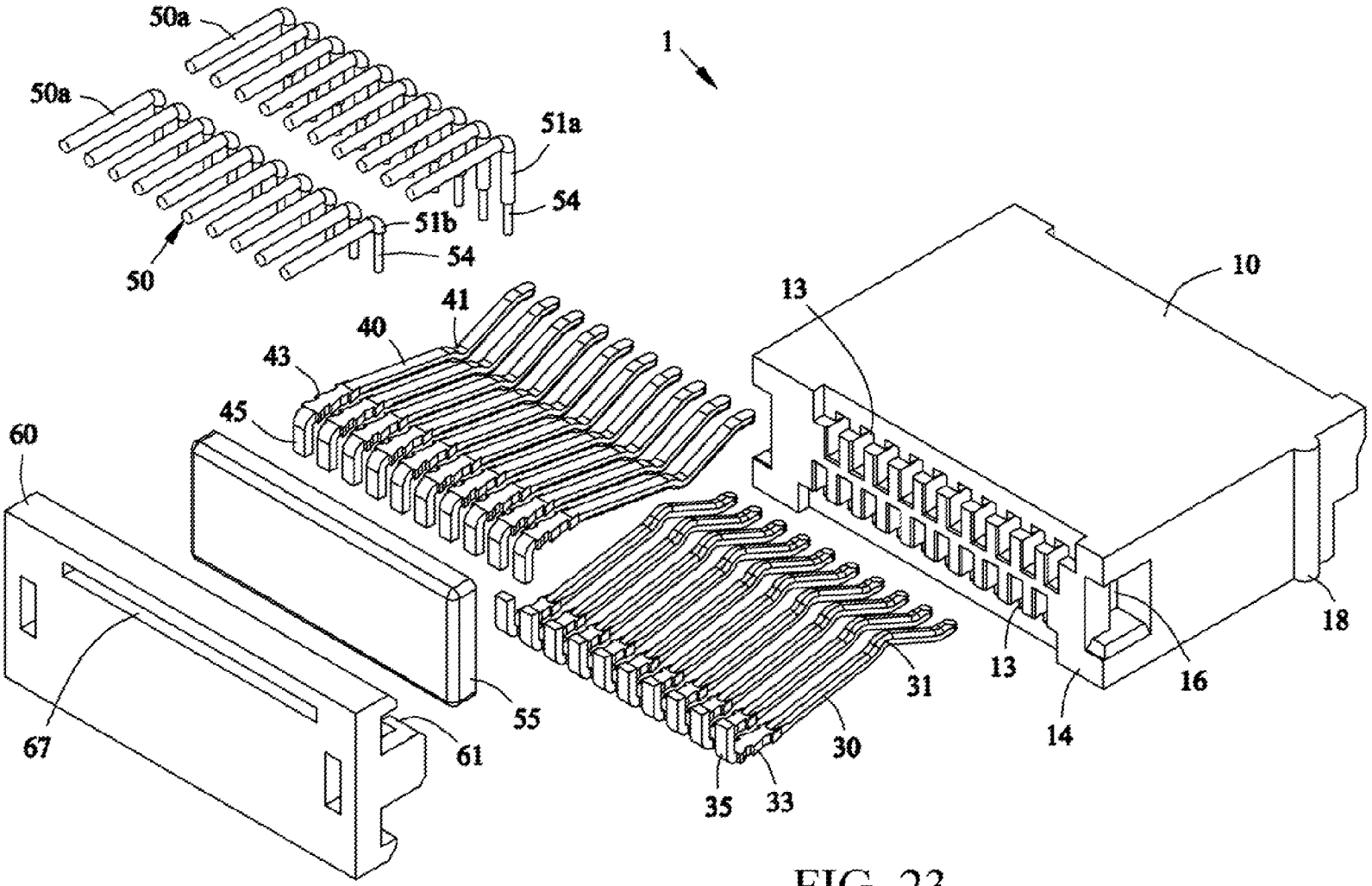
FIG. 23 is an explosion diagram showing a card edge connector assembly according to a seventh embodiment of the present invention.

Please refer to FIG. 23. The card edge cable connector assembly 1 in the seventh embodiment is mostly the same as the sixth embodiment, and the difference between them is: in the seventh embodiment, the cover 60 comprises a rectangular hole 67. The line transmission device 50 can stretch outside via the rectangular hole 67 of the cover 60. This also obeys the spirit of the present invention.

Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A card edge cable connector assembly comprising:

an insulating housing, comprising a plurality of first terminal holes, a plurality of second terminal holes, and a plurality of grooves;

a first circuit board, comprising a plurality of first soldering portions, a plurality of second soldering portions, and a plurality of contacts;

a plurality of first terminals, fastened in the grooves of the insulating housing, and ends of the first terminals are soldered together with the first soldering portions of the first circuit board;

a plurality of second terminals, fastened in the grooves of the insulating housing, and ends of the second terminals are soldered together with the second soldering portions of the first circuit board;

a line transmission device, comprising a plurality of conductors electrically connected to the contacts of the first circuit board; and a covering body, positioned in an end of the insulating housing and a front of the line transmission device in an over-molding way;

wherein the insulating housing further comprises a plug space, the first terminal holes are located on a top of the plug space, the second terminal holes are located on a bottom of the plug space, mating portions of the first terminals stretch into the plug space via the first terminal holes, and mating portions of the second terminals stretch into the plug space via the second terminal holes.

2. The card edge cable connector assembly of claim 1, wherein the first terminals are above the second terminals, and the mating portions of the first terminals and the mating portions of the second terminals are interlaced.

3. The card edge cable connector assembly of claim 1, further comprising: a pulling band positioned on the insulating housing, wherein the insulating housing comprises a positioning block on a first side, and a pair of guiding blocks on a front end.

4. The card edge cable connector assembly of claim 1, further comprising:

a second circuit board, comprising a card edge portion, comprising a plurality of contacts on a front and a back of the card edge portions;

wherein the card edge portion is capable of being plugged into the plug space of the insulating housing and the mating portions of the first terminals are capable of being electrically connected to the contacts on the front of the card edge portion, the mating portions of the second terminals are capable of being electrically connected to the contacts on the back of the card edge portion.

5. The card edge cable connector assembly of claim 4, wherein a thickness of a first side of the insulating housing is less than a thickness of a second side of the insulating housing, and the first side of the insulating housing is capable of being plugged into a groove of the second circuit board.

6. The card edge cable connector assembly of claim 4, wherein the second circuit board comprises a groove and a positioning portion, the insulating housing comprises a positioning block on a first side, the first side of the insulating housing is capable of being inserted into the groove of the second circuit board, and the positioning block is capable of being secured to the positioning portion of the second circuit board.

7. The card edge cable connector assembly of claim 4, further comprising a third circuit board, comprising a flex flat cable connector, wherein the line transmission device is capable of being inserted into the flex flat cable connector such that the third circuit board is electrically connected to the card edge cable connector assembly.

8. The card edge cable connector assembly of claim 1, wherein the line transmission device is a flex flat cable, a flexible printed circuit board, or a wire cable.

* * * * *